United States Patent [19]

Ganzmann

[11] Patent Number: 4,912,798

[45] Date of Patent: Apr. 3, 1990

[54] SWEEPER CYLINDER ON A STREETCLEANING VEHICLE

[75] Inventor: Herbert Ganzmann, Hausern, Fed. Rep. of Germany

[73] Assignee: Ing. Alfred Schmidt, GmbH, St. Blasien, Fed. Rep. of Germany

[21] Appl. No.: 279,046

[22] Filed: Dec. 2, 1988

[30] Foreign Application Priority Data

Dec. 4, 1987 [DE] Fed. Rep. of Germany ..... 3741178

[51] Int. Cl.[4] ..... E01H 5/08

[52] U.S. Cl. ..... 15/82; 37/233

[58] Field of Search ..... 15/82-86, 15/340.3, 340.4; 37/232, 233

[56] References Cited

U.S. PATENT DOCUMENTS 4,760,657 8/1988 Ganzmann et al. ..... 37/232

FOREIGN PATENT DOCUMENTS

| | | | |
|---|---|---|---|
| 925539 | 5/1973 | Canada . | |
| 457595 | 7/1912 | France | 15/82 |
| 17702 | 8/1912 | France | 15/82 |
| 24624 | 9/1922 | France | 15/82 |
| WO85/04081 | 9/1985 | PCT Int'l Appl. . | |

*Primary Examiner*—Edward L. Roberts

*Attorney, Agent, or Firm*—Helfgott & Karas

[57] ABSTRACT

A snow sweeper roller is mountable on a streetcleaning vehicle so that it is suspended and is vertically swingable and rotatable about a horizontal longitudinal shaft capable of being set oblique to the lengthwise direction of the vehicle on its under side. To avoid damage to a curb-end bearing of the sweeper roller, the bearing is provided with a guard on the outside of which has a forward cone converging towards the axis of the bearing shaft. The guard is mounted centrically rotatable on a•cover of the bearing of the sweeper roller.

4 Claims, 4 Drawing Sheets

SWEEPER CYLINDER ON A STREETCLEANING VEHICLE

The invention relates to a sweeper cylinder according to the generic clause of claim 1.

Such a sweeper cylinder has been described in German Pat. No. 3,526,883. Since such sweepers are ordinarily mounted oblique to the lengthwise direction of the vehicle on the under side, front or rear of the vehicle, in operation there is often a collision of the curb end of the sweeper, which projects slightly, against the edge of the curb. The result is damage to the associated bearing of the sweeper and/or the suspension whereby the sweeper is mounted on the vehicle.

In this connection, the object of the present invention is to reduce the hazard of damage to the generic sweeper in collision with the edge of a curb.

This object is accomplished, according to the invention, in the manner of the characterizing clause of claim 1. By virtue of the approach cone, the associated end of the roller will climb the curbstone as soon as the guard strikes the edge. Here the cooperation of the approach cone with the sweeper suspension, capable of swinging vertically on a horizontal axis, is essential. Only this will serve to avoid hard impacts and wedging of the curb end of the sweeper against the curb. Owing to the rotatable mounting of the guard, a grinding encounter is avoided. At the time of encounter, the point of contact remains more or less stationary, the guard co-rotating as the vehicle moves and at the same time lifting the sweeper with its suspension by the action of the cone. Wear of the guard by friction with the edge of the curb or a comparable obstruction is thereby largely avoided or much reduced.

Within the scope of the invention, of course, both ends of the sweeper may be provided with a guard.

For other advantageous refinements of the proposal of the invention, reference is made to the subsidiary claims.

Figure 4:
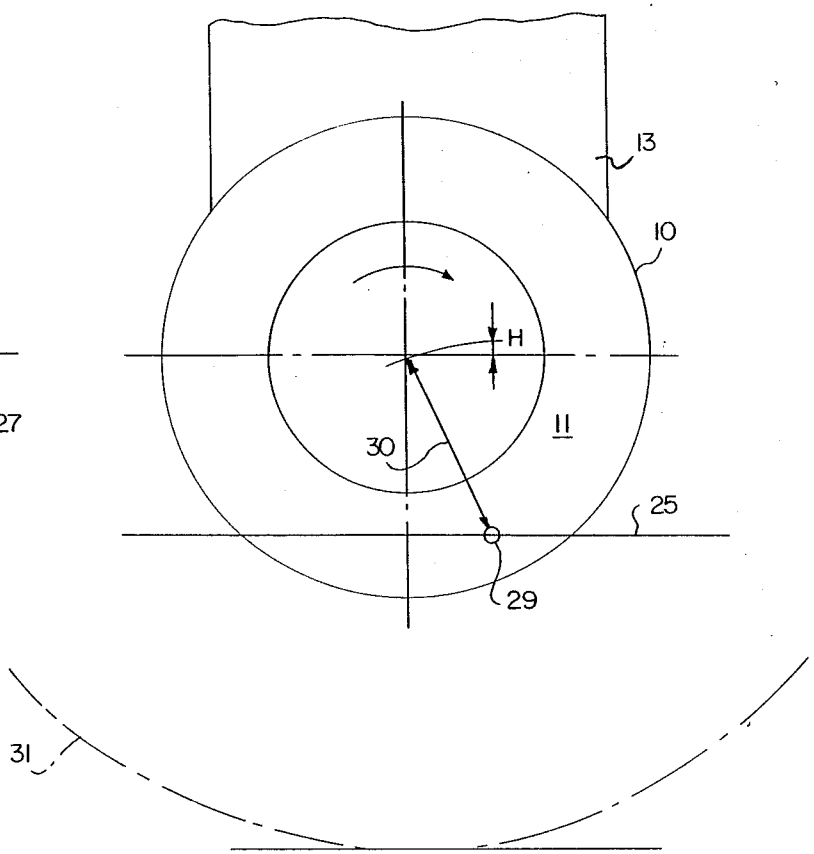
Figure 5:
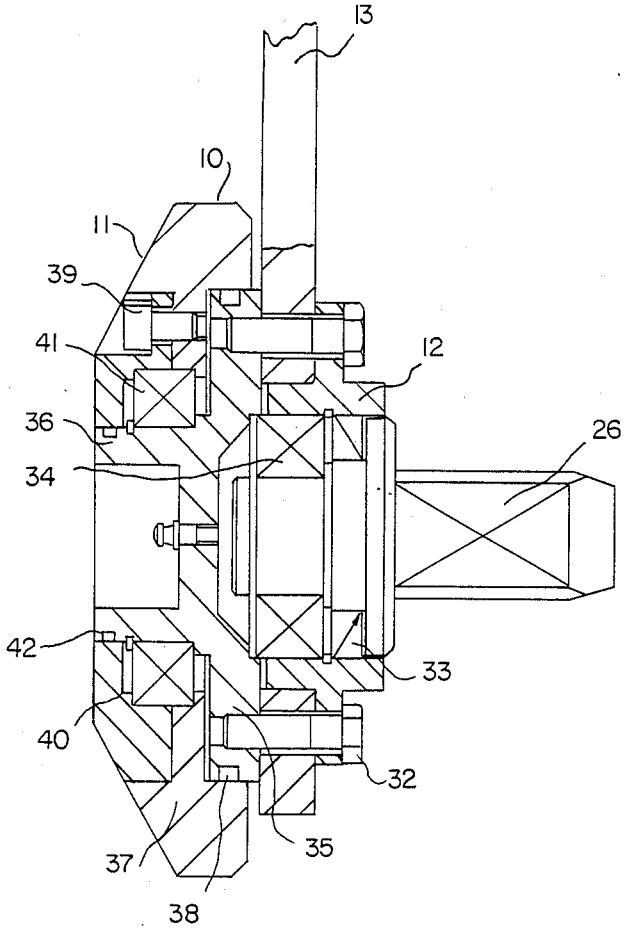

In the following, an embodiment of the invention will be illustrated with reference to the drawings by way of example. In the drawing, FIG. 1 shows a side view of a sweeper cylinder installed between the axles of a streetcleaning vehicle, FIG. 2 shows a top view of the sweeper in FIG. 1, FIG. 3 shows an enlarged view of the curb end of the sweeper, FIG. 4 shows a schematic end view of the sweeper of FIG. 3, and FIG. 5 shows an axial section of the bearing of the sweeper of FIG. 3.

Figure 1:
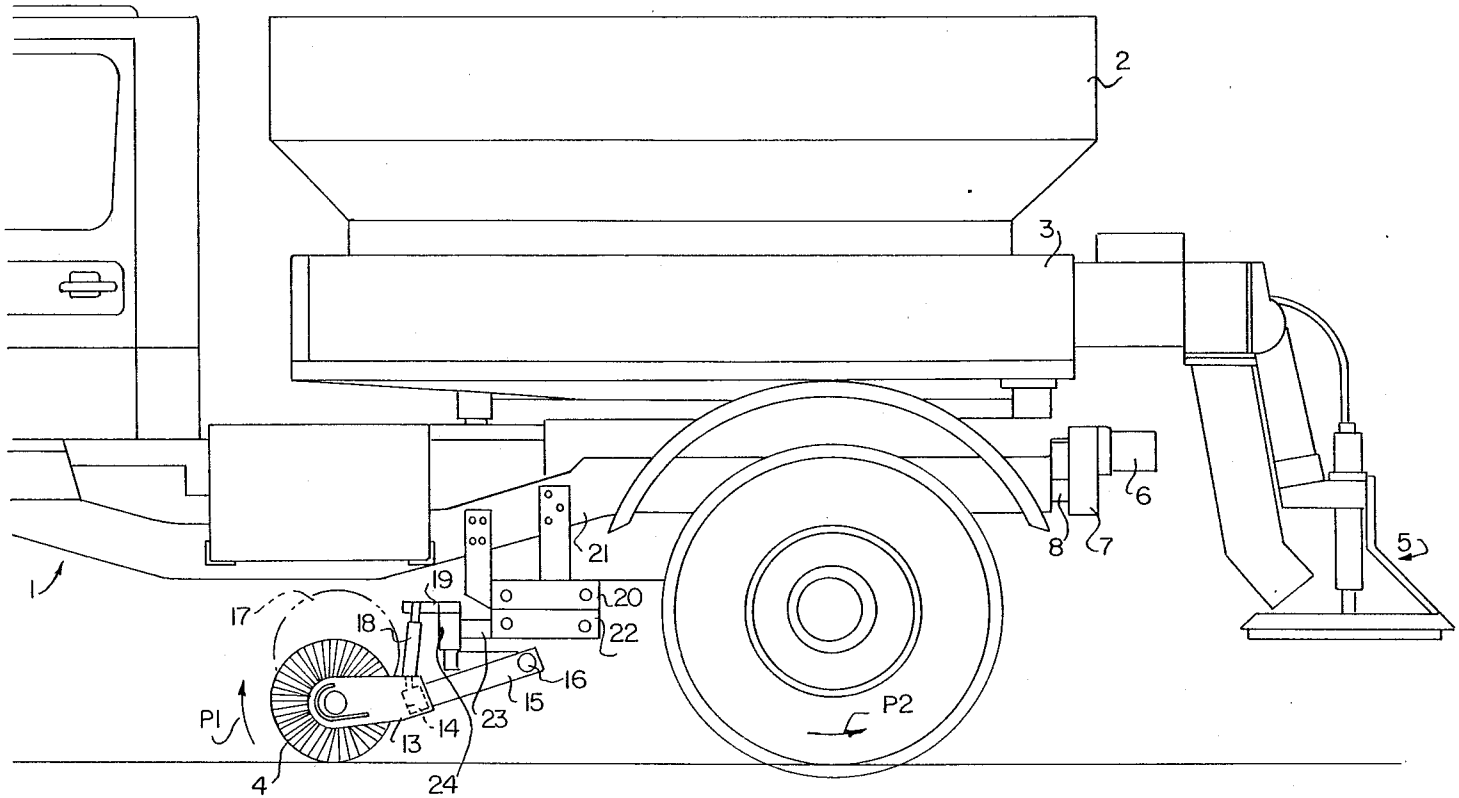
Figure 2:
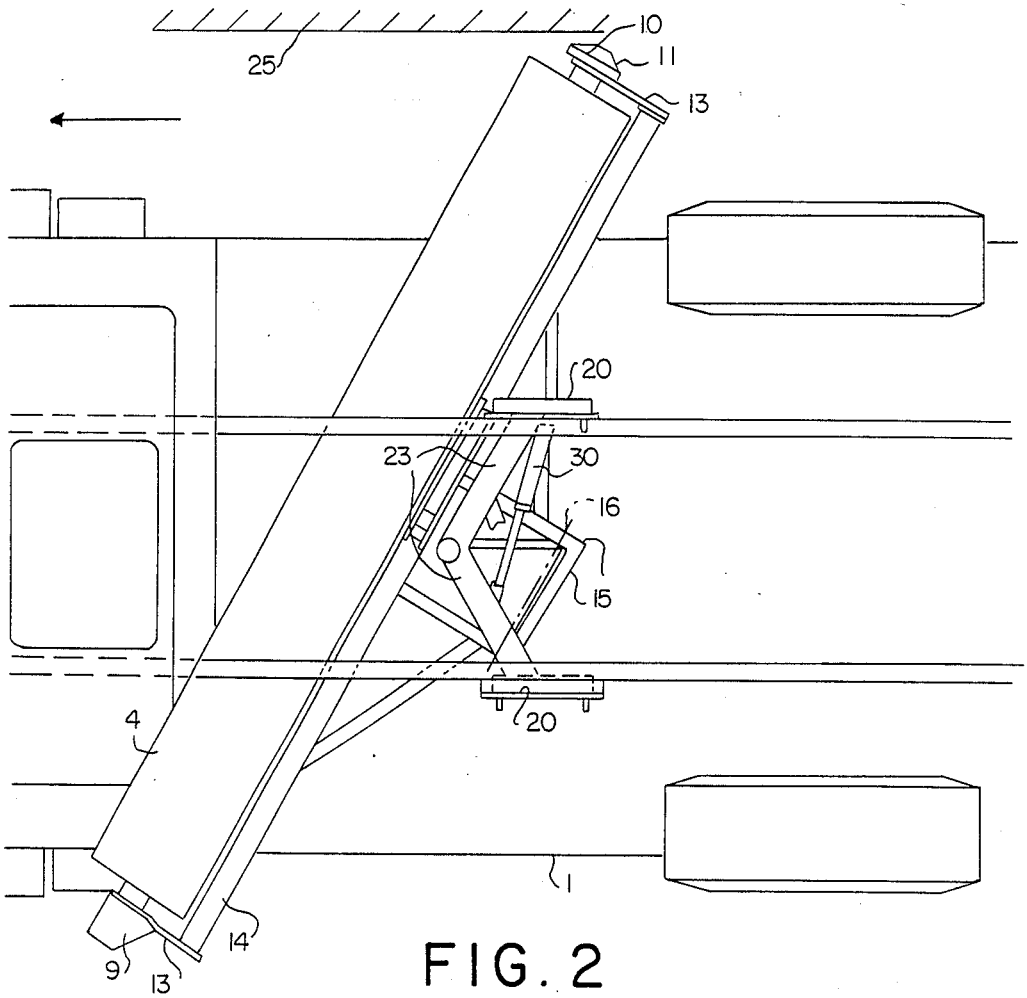
Figure 3:
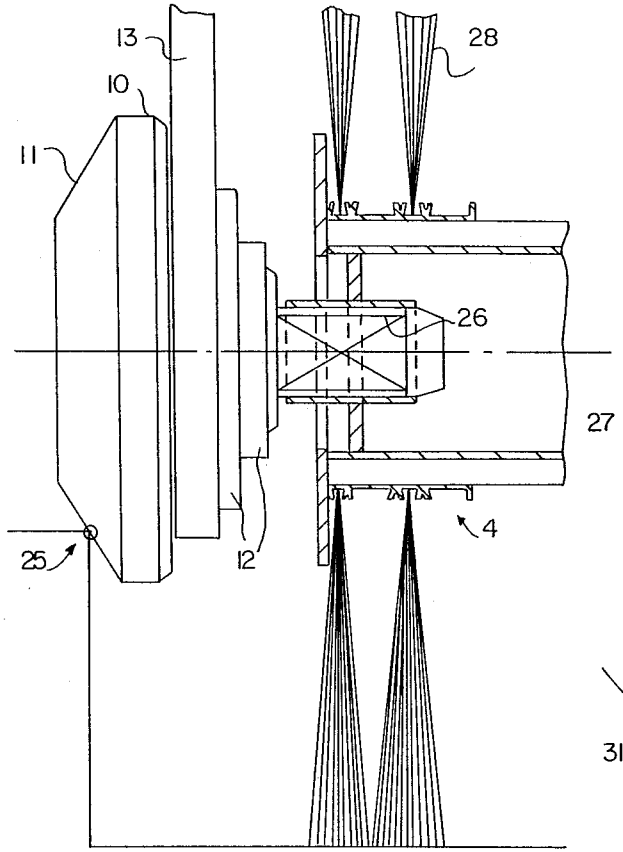

FIGS. 1 and 2 show a streetcleaning vehicle having a salt hopper (2) on its bed (3). The front axle of the vehicle (1) is not shown. It may be supposed that a snow plow is attached to the front end of the vehicle (1). The remnant of snow not removed by the plow is thrown aside out of the roadway by a snow sweeper (4) mounted on the under side of the vehicle between the axles. A salt dispenser (5) attached to the rear of the vehicle (1) provides for a grainy road surface free from ice.

The snow sweeper (4) rotates, relative to the view shown, clockwise in the direction of the arrow P1, that is to say, contrary to the rotation of the vehicle wheels in the direction of the arrow P2 in forward travel of the vehicle (1).

The snow sweeper (4) is driven hydraulically by means of a pump (6) flanged to a transmission (7) in the rear, driven by an engine shaft (8). A hydraulic motor (9) (FIG. 2) to drive the sweeper (4) is mounted axially on its bearing on the left in the direction of travel. The hydraulic motor (9) is driven by way of a hydraulic connection, not shown, by the hydraulic pump (6).

The snow sweeper (4) is rotatably mounted in a frame of lateral bearing arms (13) and a traverse (14) connecting them. To the transverse (14) is welded a U-iron (15) made up of box sections, suspended swingably about a horizontal axis (16) to raise and lower the sweeper (4). In FIG. 1, the sweeper (4) is shown in lowered position; the raised position is indicated by the dot-dash line (17). To raise or lower the sweeper (4), two hydraulic cylinders (18) are mounted on the traverse (14) at one end and on a vehicle suspension at the other end. This suspension comprises brackets (20) fixed to the vehicle and flanged to opposed members (21) of the chassis of the vehicle (1). To the brackets (20) are attached braces (23) for a vertical pivot (24) by means of an attachment flange (22).

In FIG. 2, the snow sweeper (4) is shown in top view on the vehicle (1), the essential outlines of the vehicle being indicated in the right-hand swing position, with one swing cylinder (30) extended.

The right-hand end of the sweeper (4), in the direction of travel, moves parallel to the edge of the curb (25) of the roadway to be cleared when the vehicle is in service, as shown in FIG. 2. The corresponding bearing of the sweeper (4) is protected on the outside by a guard (10) mounted axially on the bearing and fitted with an approach cone (11).

FIG. 3 shows the guard (10) enlarged, in a position in which the cone (11) provided on the guard (10) is just touching the edge of the curb (25), i.e. resting upon it. The associated bearing (12) of the sweeper is held by the arm (13); the inner race rests on a bearing pin (26) accommodated rotationally fixed in the center of the shaft (27) of the snow sweeper (4) with its bunches of bristles (28).

In FIG. 4, the point of contact between the approach cone (11) and the edge of the curbe (25) is indicated by a mark (29). Since the guard (10) is rotatably mounted, its approach cone (11) more or less rides up the curb (25), lifting the entire snow sweeper (4) by an amount H by way of the lever arm (30). In this way, damage to the curb end of the snow sweeper (4) is largely avoided. The rotatable mounting of the guard (10) moreover largely avoids abrasion between it and the edge of the curb. A dot-dash line (31) indicates the outline of the snow sweeper.

FIG. 5, to a larger scale, shows an axial section of the curb end bearing (12) of the snow sweeper, flanged to the bearing arm (13) by means of screws (32). The bearing pin (26) is rotatably accommodated in the bearing (12) by way of a rolling bearing (34); a sealing ring (33) prevents entry of water, salt, dirt etc. into the bearing (34). On the outside of the bearing arm (13), the screws (32) likewise attach a bearing cover (35) on which a hub (36) is formed at the center of the bearing shaft. On the hub (36), the guard (10) is rotatably mounted by means of a ball bearing (41). The guard (10) is bipartite, comprising an outer ring (37) and an insert ring (40). The outer ring (37) encloses the bearing cover (35) both radially and axially. In the region of axial overlap, a sealing ring (38) is provided to seal the bearing surfaces against entry of water and salt. To the outer ring (37) of the guard (10), the insert ring (40) is connected by means of screws (39). The insert ring (40) likewise rests on the ball bearing (41) and is sealed from the hub (36) at its inner periphery by means of an additional sealing ring (42). Thus the outer ring (37) and the insert ring (40) together form the approach cone (11) whose function has been described above.

I claim:

1. Sweeper roller mountable on a streetcleaning vehicle, in particular a snow sweeper replaceably mountable on such a vehicle, said sweeper roller being suspended, vertically swingable and rotatable about a horizontal longitudinal axle thereof capable of being set oblique to a lengthwise direction of the vehicle, the sweeper roller comprising at least a curb-side bearing as viewed in the direction of travel of the vehicle, said bearing including a bearing cover and being provided in a hub region thereof with a guard having an exterior which has a front cone converging towards a bearing axis, said guard being centrically rotatably supported on said bearing cover.

2. Sweeper roller according to claim 1, wherein said guard is ring-shaped and has a central bore which is rotatably mounted on a hub projecting outward from the bearing cover in an axial direction of the bearing.

3. Sweeper roller according to claim 1 wherein an outer edge of the guard radially and axially overlaps the bearing cover.

4. Sweeper roller according to claim 1, wherein the front cone has a cone angle between 90° and 120°.

* * * * *